US009900702B2

(12) United States Patent
Ma et al.

(10) Patent No.: US 9,900,702 B2
(45) Date of Patent: Feb. 20, 2018

(54) SPEAKER

(71) Applicants: Jing Ma, Shenzhen (CN); Long Zhang, Shenzhen (CN)

(72) Inventors: Jing Ma, Shenzhen (CN); Long Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/296,340

(22) Filed: Oct. 18, 2016

(65) Prior Publication Data

US 2017/0134863 A1 May 11, 2017

(30) Foreign Application Priority Data

Nov. 5, 2015 (CN) ..... 2015 2 0878715 U

(51) Int. Cl.

| | |
|---|---|
| ***H04R 9/02*** | (2006.01) |
| ***H04R 9/06*** | (2006.01) |
| *H04R 7/12* | (2006.01) |
| *H04R 7/20* | (2006.01) |

(52) U.S. Cl.

CPC ..... *H04R 9/022* (2013.01); *H04R 9/025* (2013.01); *H04R 9/06* (2013.01); *H04R 7/12* (2013.01); *H04R 7/20* (2013.01); *H04R 2209/024* (2013.01)

(58) Field of Classification Search

CPC . H04R 7/18; H04R 7/20; H04R 9/022; H04R 9/025; H04R 9/045; H04R 9/046; H04R 9/06; H04R 2209/024

See application file for complete search history.

(56) References Cited

U.S. PATENT DOCUMENTS

| | | | | |
|---|---|---|---|---|
| 2005/0129265 | A1* | 6/2005 | Nakajima | H04R 9/022 381/412 |
| 2008/0304694 | A1* | 12/2008 | Hayashi | H04R 9/022 381/397 |
| 2012/0328147 | A1* | 12/2012 | Kim | H04R 9/025 381/400 |
| 2016/0021444 | A1* | 1/2016 | Behles | H04R 1/288 381/354 |

* cited by examiner

*Primary Examiner* — Joshua Kaufman

(74) *Attorney, Agent, or Firm* — Na Xu; IPro, PLLC

(57) ABSTRACT

A speaker is provided in the present disclosure. The speaker includes a magnetic circuit system for providing magnetic field, a diaphragm, a suspension, a drive mechanism and a horizontal former, which is retained on the surface of the diaphragm directly facing the magnetic circuit system. The diaphragm is suspended above the magnetic circuit system for generating sound by vibrating. The suspension is used to suspend the diaphragm above the magnetic circuit system. The drive mechanism is disposed under the diaphragm and can interact with the magnetic circuit system so as to drive the diaphragm to vibrate in order to generate sound. The horizontal former is retained on the surface of the diaphragm directly facing the magnetic circuit system, wherein the horizontal former is provided with a communication space which communicates the space under the diaphragm and the space under the suspension.

7 Claims, 5 Drawing Sheets

SPEAKER

FIELD OF THE DISCLOSURE

The present invention relates to the field of electro-acoustic transducers, and in particular, relates to a speaker.

BACKGROUND

With the rapid development of science and technology, the popularity rate of the audio devices has become higher and higher. The users not only require the audio devices to play videos and audios, but also put more and more demands on the reliability of the audio devices. Especially with the advent of 3G/4G times, the mobile multimedia technology has also flourished. Some audio devices have a variety of entertainment functions, such as video play, digital photographing, game, GPS navigation and the like. All of these functions require the electronic components in the audio device to be more and more precise and compact.

In the audio device, a speaker is a commonly used electronic component, which is mainly used to play audio signals. The related speaker in general comprises a dome for generating sound by vibrating, an edge for suspending the dome above the magnetic circuit system, and a voice coil secured beneath the junction between the dome and the edge. In the speaker with traditional structure, the space under the dome and the space under the edge are separated by the voice coil. When the dome is vibrating, the air in the space under the dome is difficult to be discharged quickly, so that the dome is damped excessively, which can reduce the vibration sensitivity of the dome, and thus increase the sound distortion. Besides, when the voice coil is driven at high power by an intelligent amplifier, it is disadvantageous to the heat dissipation of the voice coil.

Therefore, it is desired to provide a new speaker which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiments thereof.

Figure 1:
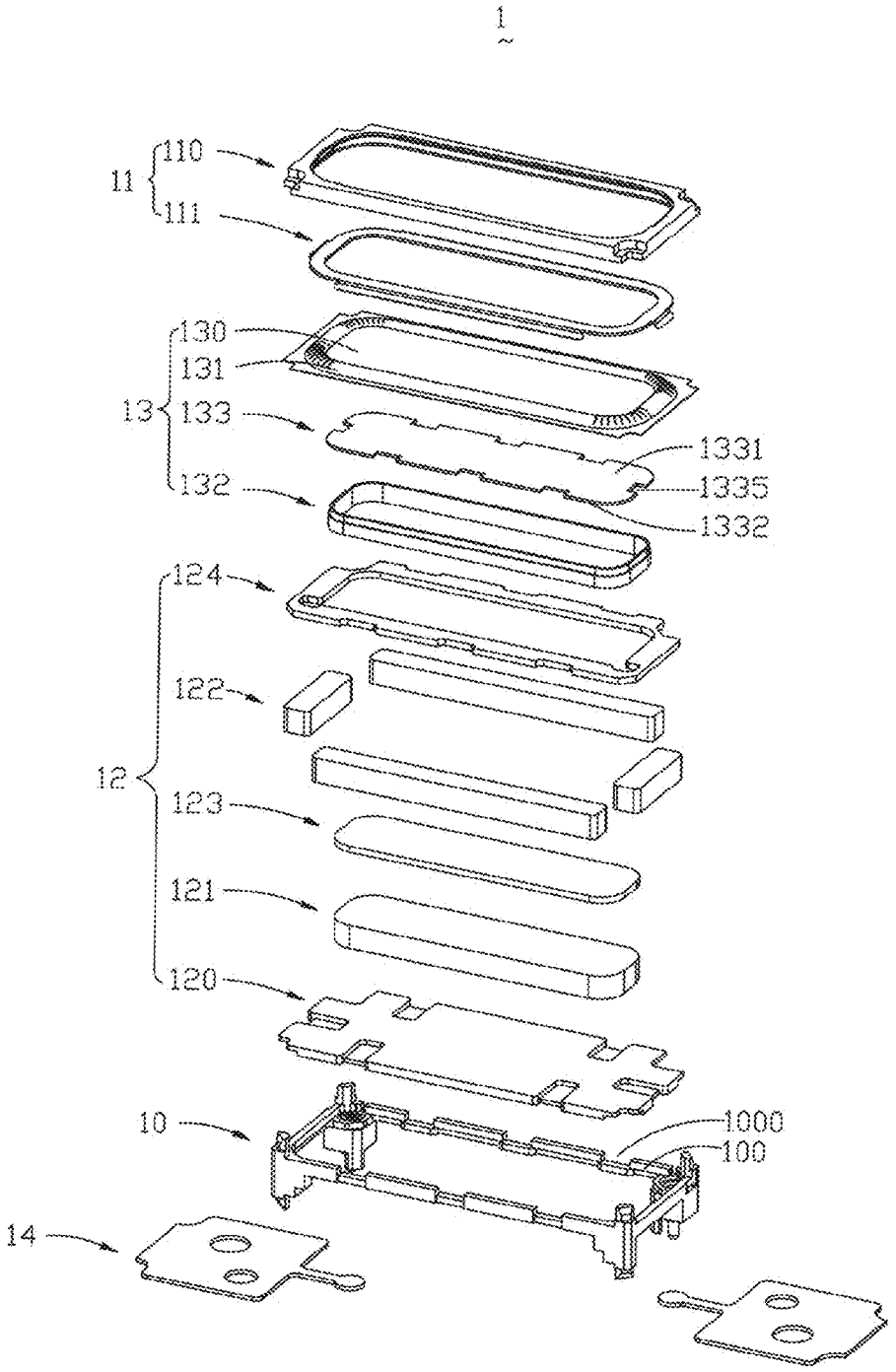
FIG. 1 is an exploded view of a speaker in accordance with an embodiment of the present disclosure.
Figure 2:
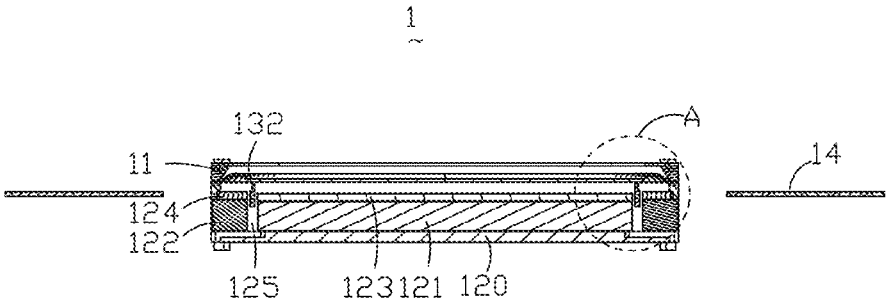
FIG. 2 is a cross-sectional view of the speaker shown in FIG. 1.

Referring to FIGS. 1-2, a speaker 1 comprises a frame 10; a front cover 11 covering and connected with the frame 10; a magnetic circuit system 12 and vibration system 13 received in the frame 10; and conductive terminals 14 secured in the frame 10 for realizing the electrical connection between the speaker 1 and the outside. The speaker 1 can receive electrical signal through the conductive terminals 14. The vibration system 13 can interact with the magnetic circuit system 13 after receiving the electrical signal, so as to generate sound by vibrating.

The magnetic circuit system 12 is used to generate magnetic field, which comprises a yoke 120 assembled at the bottom end of the frame 10; a main magnet block 121 assembled at the center of the yoke 120; auxiliary magnet blocks 122 assembled to the yoke 120 and disposed around the main magnet block 121; and a main pole plate 123 and an auxiliary pole plate 124 attached onto the upper surfaces of the main magnet block 121 and the auxiliary magnet blocks 122 respectively. The auxiliary magnet blocks 122 and the main magnet block 121 are spaced apart from each other to form a magnetic gap. The auxiliary magnet blocks 122 are made up by four magnet blocks not connected with each other. The auxiliary pole plate 124 is in the shape of rectangular ring.

The vibration system 13 comprises a diaphragm 130 for generating sound by vibrating; a suspension 131; a drive mechanism 132; and a horizontal former 133.

The suspension 131 can be used to suspend the diaphragm 130 above the magnetic circuit system 12. The inner perimeter of the suspension 131 is connected with the diaphragm 130. The outer perimeter of the suspension 131 is secured onto the frame 10. A distance between the diaphragm 130 and the magnetic circuit system 12 is larger than the maximum amplitude of the diaphragm 130, so that the diaphragm 130 can be prevented from impacting the magnetic circuit system 12. The Young's modulus of the suspension 131 should be smaller than the Young's modulus of the diaphragm 130. The suspension 131 has certain elastic deformation capability, so as to provide elastic force for the vibration of the diaphragm 130.

The drive mechanism 132 is disposed under the diaphragm 130 and can interact with the magnetic circuit system 12 so as to vibrate the diaphragm 130 to generate sound. The drive mechanism 132 comprises coil windings (which are equivalent to voice coil) suspended in the magnetic circuit system 125. When the drive mechanism 132 receives electrical signal, the coil windings can interact with the magnetic field in the magnetic gap 125 to make reciprocating vibration along the vibrating direction of the vibration system 13, thereby enhancing the vibration of the diaphragm 130.

The horizontal former 133 is retained on the surface of the diaphragm 130 directly facing the magnetic circuit system 12 and forms a dome together with the horizontal former 133. The Young's modulus of the horizontal former 133 is larger than the Young's modulus of the diaphragm 130. The drive mechanism 132 is coupled to the horizontal former 133 in a way that the area spanned by the drive mechanism 132 is no more than the area of the diaphragm 130. In this way, the orthographic projection of the drive mechanism 132 onto the diaphragm 130 is within the extent of the diaphragm 130. Comparing with the situation in which the drive mechanism 132 is coupled to the horizontal former 133 in a way that the area spanned by the drive mechanism 132 is larger than the area of the diaphragm 130, the coupling way provided by the present invention can enable the diaphragm 130 to have larger vibration stroke, which can effectively extend the low frequency response of the speaker 1.

Figure 3:
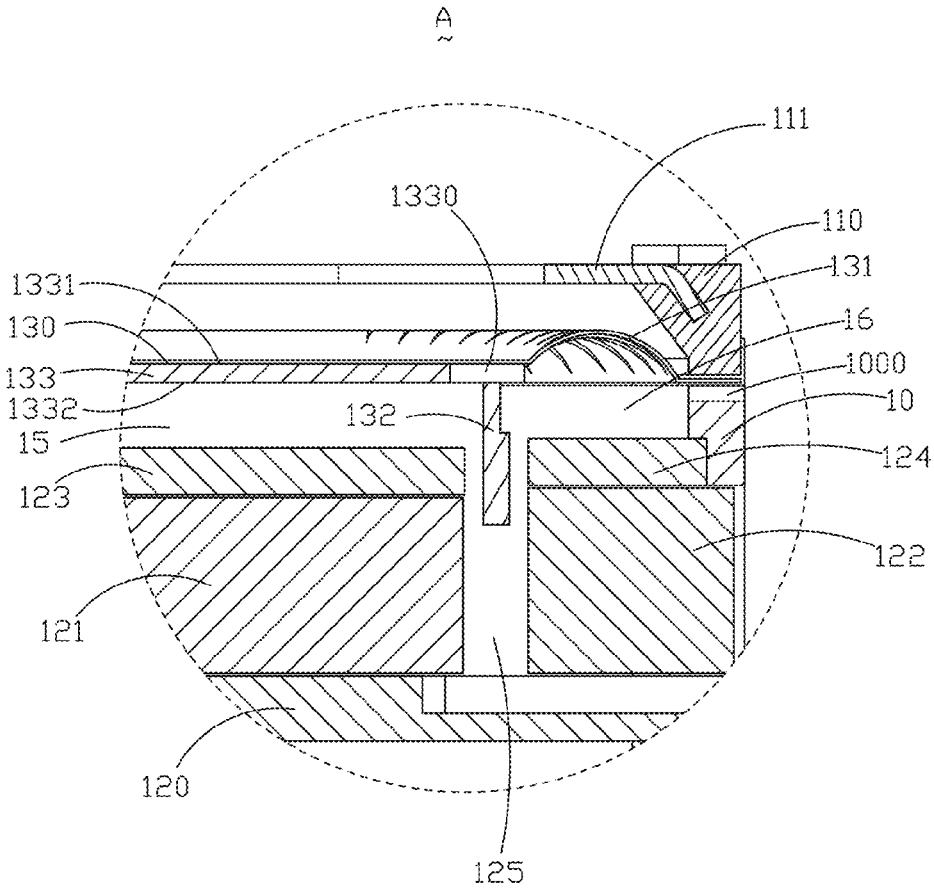
FIG. 3 is an enlarged view of the portion A shown in FIG. 2.

Also referring to FIG. 3, the horizontal former 133 is provided with a communication space 1330 which is used to communicate the space under the diaphragm 130 and the space 16 under the suspension 131. In this way, when the diaphragm 130 is vibrating, the air under it can communicate with the outside through the communication space 1330 smoothly, so as to effectively decrease the sound pressure exerted on the diaphragm 130, enhance the sensitivity of the diaphragm 130 greatly, and further improve the sound quality of the sound emitted by the diaphragm 130.

The frame 10 comprises frame side walls 100. The frame side walls 100 are provided with through holes 1000 extending through the frame side walls 100 and communicating the space 16 under the suspension 131 and the outside. The air pressure balance between the space 16 under the suspension 131 and the outside space can be achieved through the through holes 1000.

The front cover 11 comprises a plastic cover body 110 assembled on the frame 10 and a metal frame 11 injection molded onto the cover body 110 integrally.

The horizontal former 133 comprises an upper surface 1331 engaged with the diaphragm 130; a lower surface 1332 opposite to the upper surface 1331 and for retaining the drive mechanism 132; and a connecting surface 1335 connecting the upper surface 1331 and the lower surface 1332.

Figure 4:
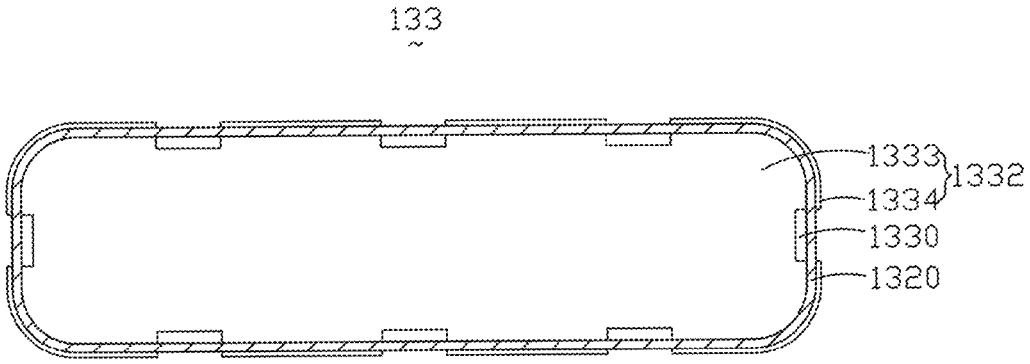
FIG. 4 is an orthographic projection of a drive mechanism in the speaker shown in FIG. 1 onto a horizontal former.
Figure 5:
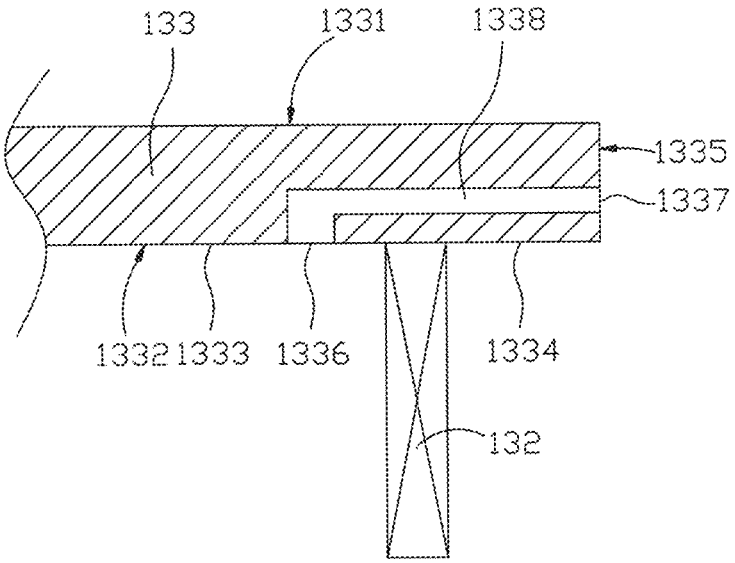
FIG. 5 is a schematic view of a communication space in the horizontal former in the speaker shown in FIG. 1 in accordance with a first embodiment.

Also referring to FIGS. 3-5, the lower surface 1332 of the horizontal former 133 comprises an inside surface 1333 surrounded by the orthographic projection 1320 of the drive mechanism 132 onto the horizontal former 133. In fact, when the drive mechanism 132 is coupled to the horizontal former 133 in a way that the area spanned by the drive mechanism 132 is smaller than the area of the diaphragm 130, the lower surface 1332 also can comprise an outside surface 133 located at the outside of the orthographic projection 1320.

In a first embodiment of the communication space 1330, the communication space 1330 comprises a first opening 1336 in the inside surface 1333; a second opening 1337 in the connecting surface 1335; and a first through groove 1338 communicating the first opening 1336 and the second opening 1337.

Figure 6:
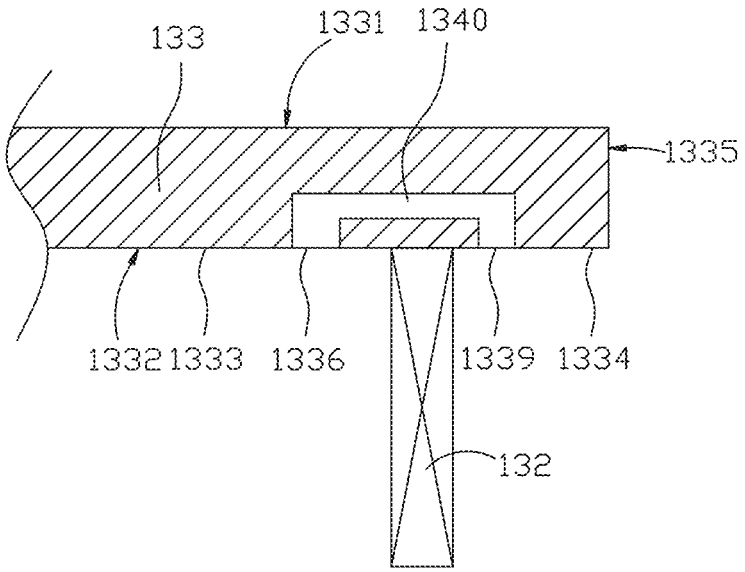
FIG. 6 is a schematic view of a communication space in the horizontal former in the speaker shown in FIG. 1 in accordance with a second embodiment.

As shown in FIG. 3, FIG. 4 and FIG. 6, in a second embodiment of the communication space 1330, the communication space 1330 comprises a first opening 1336 in the inside surface 1333; a third opening 1339 in the outside surface 1334; and a second through groove 1340 communicating the first opening 1336 and the third opening 1339.

Figure 7:
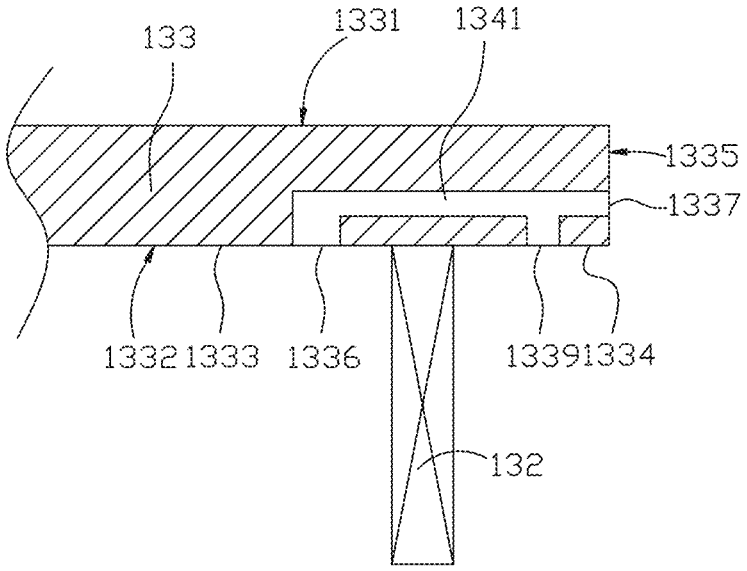
FIG. 7 is a schematic view of a communication space in the horizontal former in the speaker shown in FIG. 1 in accordance with a third embodiment.

As shown in FIG. 3, FIG. 4 and FIG. 7, in a third embodiment of the communication space 1330, the communication space 1330 comprises a first opening 1336 in the inside surface 1333; a second opening 1337 in the connecting surface 1335; a third opening 1339 in the outside surface 1334; and a third through groove 1341 communicating the first opening 1336, the second opening 1337 and the third opening 1339.

Figure 8:
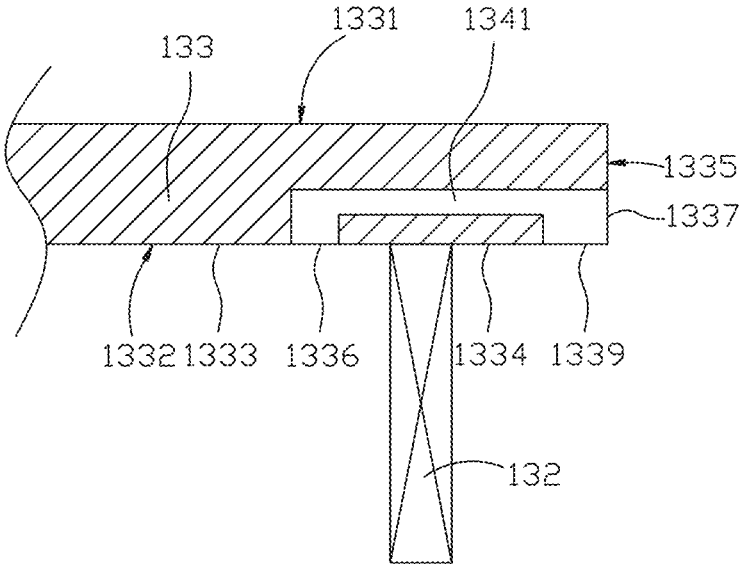
FIG. 8 is a schematic view of a communication space in the horizontal former in the speaker shown in FIG. 1 in accordance with a fourth embodiment.

As shown in FIG. 3, FIG. 4 and FIG. 8, in a fourth embodiment of the communication space 1330, the fourth embodiment is different from the third embodiment in that the second opening 1337 and the third opening 1339 are communicating with each other.

Comparing with the prior art, in the speaker according to the present invention, there is a horizontal former under a sound radiating plane, and there is a communication space in the horizontal former which can communicate the space under the sound radiating plane and the space under the suspension, so that the discharge rate of the air in the space under the sound radiating plane can be increased effectively, and thus the damping to the sound radiating plane can be decreased, thereby increasing the vibration sensitivity, reducing the sound distortion, at the same time facilitating the heat dissipation of the drive mechanism.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a magnetic circuit system for providing magnetic field;

a diaphragm, suspended above the magnetic circuit system for generating sound by vibrating;

a suspension, which is used to suspend the diaphragm above the magnetic circuit system;

a drive mechanism disposed under the diaphragm and interacting with the magnetic circuit system for driving the diaphragm; and a horizontal former retained on a surface of the diaphragm directly facing the magnetic circuit system, wherein the horizontal former is provided with a communication space which communicates the space under the diaphragm and the space under the suspension, the horizontal former comprises an upper surface engaged with the diaphragm; a lower surface opposite to the upper surface and for retaining the drive mechanism; and a connecting surface connecting the upper surface and the lower surface, the lower surface of the horizontal former comprises an inside surface surrounded by the orthographic projection of the drive mechanism onto the horizontal former and an outside surface located at the outside of the orthographic projection, the communication space comprises an inside opening in the inside surface; an outside opening in the outside surface; and a through groove communicating the inside opening and the outside opening.

2. The speaker as described in claim 1, wherein the communication space also comprises a side opening in the connecting surface, the through groove communicates the inside opening, the outside opening and the side opening.

3. The speaker as described in claim 2, wherein the outside opening and the side opening are communicated with each other.

4. The speaker as described in claim 1, wherein the distance between the diaphragm and the magnetic circuit system is larger than the maximum amplitude of the diaphragm.

5. The speaker as described in claim 1, wherein the speaker further comprises a frame for receiving the magnetic circuit system; the inner perimeter of the suspension is connected with the diaphragm; the outer perimeter of the suspension is secured onto the frame.

6. The speaker as described in claim 5, wherein the frame comprises frame side walls; the frame side walls are provided with through holes extending through the frame side walls and communicating the space under the suspension and the outside.

7. The speaker as described in claim 6, wherein the speaker also comprises a front cover covering and connected with the frame; the front cover comprises a plastic body portion and a rigid reinforcement injection molded with the plastic body portion integrally.

* * * * *